US008944723B2

(12) United States Patent
Garcia et al.

(10) Patent No.: US 8,944,723 B2
(45) Date of Patent: Feb. 3, 2015

(54) TENSIONER LATCH WITH PIVOTING SEGMENTED BASE

(71) Applicants: Jesus J. Garcia, Houston, TX (US); Joseph W. Pallini, Tomball, TX (US); Steven M. Wong, Houston, TX (US); Rockford D. Lyle, Pinehurst, TX (US); Benjamin J. Kubichek, Houston, TX (US)

(72) Inventors: Jesus J. Garcia, Houston, TX (US); Joseph W. Pallini, Tomball, TX (US); Steven M. Wong, Houston, TX (US); Rockford D. Lyle, Pinehurst, TX (US); Benjamin J. Kubichek, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 85 days.

(21) Appl. No.: 13/714,025

(22) Filed: Dec. 13, 2012

(65) Prior Publication Data

US 2014/0169887 A1 Jun. 19, 2014

(51) Int. Cl.
*E21B 17/01* (2006.01)
*E21B 19/00* (2006.01)

(52) U.S. Cl.
CPC ..... *E21B 19/004* (2013.01)
USPC ..... 405/224.4; 405/224; 405/224.1; 405/224.2; 166/355; 166/367

(58) Field of Classification Search
CPC ..... E21B 19/004
USPC ..... 405/224, 224.1, 224.2, 224.4; 166/77.51, 85.1, 242.6, 367, 345; 285/26, 29, 34, 82, 86, 87, 224
See application file for complete search history.

(56) References Cited

U.S. PATENT DOCUMENTS

| | | | | |
|---|---|---|---|---|
| 4,228,857 | A | 10/1980 | Nobileau | |
| 4,397,357 | A | 8/1983 | Hettinger | |
| 4,634,314 | A | 1/1987 | Pierce | |
| 4,712,620 | A | 12/1987 | Lim | |
| 4,799,827 | A | 1/1989 | Jaqua | |
| 6,045,296 | A | 4/2000 | Otten | |
| 7,112,011 | B2 | 9/2006 | McCarty | |
| 7,328,741 | B2 | 2/2008 | Allen | |
| 7,513,308 | B2 | 4/2009 | Hosie | |
| 7,571,772 | B2 | 8/2009 | Reams | |
| 7,632,044 | B2 | 12/2009 | Pallini | |
| 7,686,085 | B2 | 3/2010 | Ellis | |
| 7,708,498 | B2 | 5/2010 | Ellis | |
| 7,762,338 | B2 | 7/2010 | Fenton | |
| 7,819,195 | B2 | 10/2010 | Ellis | |
| 7,823,646 | B2 | 11/2010 | Ellis | |
| 8,011,858 | B2 | 9/2011 | Pallini | |
| 8,021,081 | B2 * | 9/2011 | Crotwell et al. | 405/223.1 |
| 8,074,720 | B2 | 12/2011 | Radi | |
| 8,123,438 | B2 | 2/2012 | Pallini | |
| 8,127,854 | B2 | 3/2012 | Haheim | |
| 8,141,644 | B2 | 3/2012 | Ellis | |
| 8,215,872 | B2 | 7/2012 | Pallini | |

(Continued)

*Primary Examiner* — John Kreck
*Assistant Examiner* — Carib Oquendo
(74) *Attorney, Agent, or Firm* — Bracewell & Giuliani LLP

(57) ABSTRACT

A tensioner assembly for applying tension to a tubular member, such as a riser, can include an upper latch connected to the tubular member, a platform with a bore, and a plurality of lower latch segments, each having a base that is pivotally connected to the platform. After applying tension to the tubular member, the segments pivot inward to form an annular lower latch ring having an inner diameter less than an outer diameter of the upper latch. The assembly can include a locking mechanism that prevents axial movement of the upper latch, relative to the lower latch ring, after engagement. The upper latch can self-center on the lower latch as it is moved into the latching position.

18 Claims, 7 Drawing Sheets

(56) References Cited

U.S. PATENT DOCUMENTS

| | | | |
|---|---|---|---|
| 8,286,714 | B2 | 10/2012 | Ellis |
| 8,333,243 | B2 | 12/2012 | Pallini, Jr. |
| 8,388,255 | B2 | 3/2013 | Larson |
| 2005/0147473 | A1 | 7/2005 | Pallini |
| 2006/0108121 | A1 | 5/2006 | Ellis |
| 2006/0280560 | A1 | 12/2006 | Ellis |
| 2007/0056739 | A1 | 3/2007 | Ellis |
| 2007/0063507 | A1 | 3/2007 | Reams |
| 2007/0181310 | A1 | 8/2007 | Ellis |
| 2007/0196182 | A1 | 8/2007 | Ellis |
| 2007/0284113 | A1 | 12/2007 | Haheim |
| 2008/0128138 | A1 | 6/2008 | Radi |
| 2008/0166186 | A1 | 7/2008 | Pallini |
| 2008/0205992 | A1 | 8/2008 | Ellis |
| 2010/0143047 | A1 | 6/2010 | Pallini |
| 2010/0183376 | A1 | 7/2010 | Ellis |
| 2010/0254767 | A1 | 10/2010 | Pallini |
| 2010/0260556 | A1 | 10/2010 | Pallini |
| 2011/0008099 | A1 | 1/2011 | Larson |
| 2011/0200397 | A1 | 8/2011 | Pallini |
| 2012/0061091 | A1 | 3/2012 | Radi |
| 2012/0070225 | A1 | 3/2012 | Wallace |
| 2012/0099930 | A1 | 4/2012 | Pallini |
| 2012/0103622 | A1 | 5/2012 | Fenton |
| 2012/0207550 | A1 | 8/2012 | Aksel |

* cited by examiner

TENSIONER LATCH WITH PIVOTING SEGMENTED BASE

BACKGROUND OF THE INVENTION

1. Field of the Invention

The present invention relates in general to mineral recovery wells, and in particular to an apparatus and method for supporting a tensioned tubular assembly.

2. Brief Description of Related Art

Tubular members such as wellbore risers are often placed under tension. A riser, for example, can extend from a subsea wellhead upward to a drilling platform. It is often necessary to place a certain amount of tension on the riser. The tension can be applied by, for example, latching the riser into place on the wellhead, and then drawing it upward through an opening in a drilling platform until the riser is subject to the desired amount of tension. The riser can then be latched into place by a latching mechanism on the drilling platform to maintain the tension.

The tension latch provides the connection between the riser tension joint and tensioner system on a floating platform. It sits atop the tension conductor, which is located on a deck of the platform. As the riser is made up, all segments of the riser system must pass through a rotary or a spider. The limitation on the riser is the greatest outer diameter ("OD") on the riser must be less than the inner diameter ("ID") of the spider. The same limitation is also present at the tensioner, the largest OD must be able to pass through the tension latch. Conventional methods of tensioning and latching a riser have numerous problems.

With conventional tension latches, it can be difficult to center the riser assembly within the opening of the drilling platform or within the latching mechanism. If the riser is offset within the opening, then it can be difficult, or even unsafe, to latch the riser in position with conventional latching mechanisms. Those conventional latching mechanisms can include segmented dogs that can engage the riser assembly. It is difficult to engage in the riser with segmented dogs when the riser is offset. Engaging the riser with the segmented dogs can also require personnel to be present on the drilling platform to operate heavy equipment. Safety can be an issue any time personnel are operating heavy equipment, especially in close proximity to a tensioned riser. Furthermore, heavy equipment must be lifted and operated in order to engage the riser with the segmented dogs, which can further present safety issues. Additionally, the conventional latching mechanisms have a large number of moving parts. Those moving parts can be expensive and can have mechanical failures.

Another problem with conventional latching techniques is that they are not able to prevent upward movement of the riser assembly. Under some circumstances, risers can be subjected to upward force that can cause the riser assembly to thrust upward from the drilling platform. Conventional risers are not suited to provide downward support to prevent a riser assembly from thrusting upward.

SUMMARY OF THE INVENTION

This application discloses embodiments of a tension latch assembly that is used to maintain a predetermined amount of tension on a tubular member, such as a riser extending from a subsea wellhead to a drilling platform. In various embodiments, the tension latch assembly includes a plurality of latch segments connected to the drilling platform around a bore through the platform. The latch segments pivot inward, toward the bore, to form an annular lower latch ring. An upper annular latch, which can be a solid ring, is connected to the riser. The upper latch lands on the annular lower latch ring to maintain tension on the riser.

More specifically, in embodiments of the present design the latch ring includes two separate components. There is a lower latch that is a segmented ring design with a housing as a single piece component. The lower latch segments are connected to a base ring, which can be a solid ring or a segmented ring, that is connected to the drilling platform. The upper latch is a solid ring latch that is run on the tension joint. As the riser is run, the lower latch ring segments are pivoted back to allow clearance of the upper latch, thus allowing the riser to pass with no ID limitations. The tension joint is run with the solid annular latch preinstalled at a pre-determined position. Once the riser is close to the landed position, the lower latch ring and housing assembly are rotated inward into position, with the lower latch segments collapsing to form a solid ring. The lower segmented ring and housing assembly can now accept the upper solid ring, as it is lowered into place.

The lower segmented latch has a landing surface, which is angled inward. This causes the upper latch (and the tension joint) to "self-center" in the lower latch, which eliminates the need for intervention by an operator when engaging the system. A retaining clamp is attached to the solid ring and segmented base to stop any upward force that may cause separation of the components. Embodiments can have a flat interface between the solid latch ring and the segmented base. Alternatively, embodiments can have a tapered surface to self center and also keep the lathes more centralized in the segmented base.

In operation, the solid upper tension latch is installed on the tension joint (prior to welding). The tension joint is passed down through the tensioner with a centralizer ring attached to keep the tension joint (riser) in the correct position. Once the exact location of the upper tension latch is determined, the latch is rotated on the threads on the tension joint to determine the exact position and is placed in that position. The upper tension latch outer diameter is small enough to pass through the rotary or spider. The lower segmented base is pivoted backwards, to an open position, to allow larger diameters to pass. Once the tension joint is in the appropriate location (and the upper tension latch is in place), the lower latch segments are pivoted inward to form a solid ring. The geometry at the mating face of the upper tension latch and lower latch allows the pieces to self center as it is lowered into its final position, regardless of initial offset. The "self-centering" is caused by an inward angle on the mating surface of the two components. This system will centralize (without human intervention) even when the tension joint is at the maximum offset allowed by the centralizer. Indeed, the upper latch will self-center within the lower latch ring even if the upper latch and tension joint are off center by up to a predetermined amount.

The upper tension latch is centered as it lands out on the lower tension latch. A retaining clamp is attached to the solid ring and segmented base to prevent any upward force from separating the components. Alternative embodiments can work under the same principle with a radius interface between the solid latch and segmented base. The segmented base can accept the maximum offset from the tension joint and as the load is transferred to the tension ring the segments will rotate together and self-center.

In embodiments, an apparatus for providing tension to a riser includes a platform having a bore therethrough, a tubular member extending through the bore, and an annular upper latch member connected to an outer diameter of the tubular member, the upper latch member having an end surface. Embodiments of the apparatus also include a plurality of latch segments positioned circumferentially around the bore, each of the plurality of latch segments being moveable between an open position and an engaged position, the plurality of latch segments, in the open position, defining an inner diameter greater than an outer diameter of the upper latch member, and in the engaged position, an engagement end of each of the latch segments being nearer an axis of the bore than in the open position to define an annular latch ring having inner diameter smaller than the outer diameter of the upper latch member.

In embodiments of a method for tensioning a riser, the method includes the steps of connecting an upper latch member to a tension joint, the tension joint being a segment of a riser assembly; providing a tower latch assembly, the tower latch assembly having a plurality of latch segments positioned around the circumference of a bore of a drilling platform, each of the segments being pivotable from an open position to an engaged position, the open position defining an inner diameter greater than an outer diameter of the upper latch member and the engaged position forming an annular latch ring having an inner diameter less than the outer diameter of the upper latch member. Embodiments of the method also include the steps of passing the tension joint downward through the inner diameter of the lower latch assembly to determine the desired amount of tension, then tensioning the riser assembly by drawing the tension joint upward through the lower latch assembly; moving the plurality of latch segments from the open position to the engaged position; and lowering the tension joint onto the lower latch assembly until the upper latch member lands on the lower latch ring.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
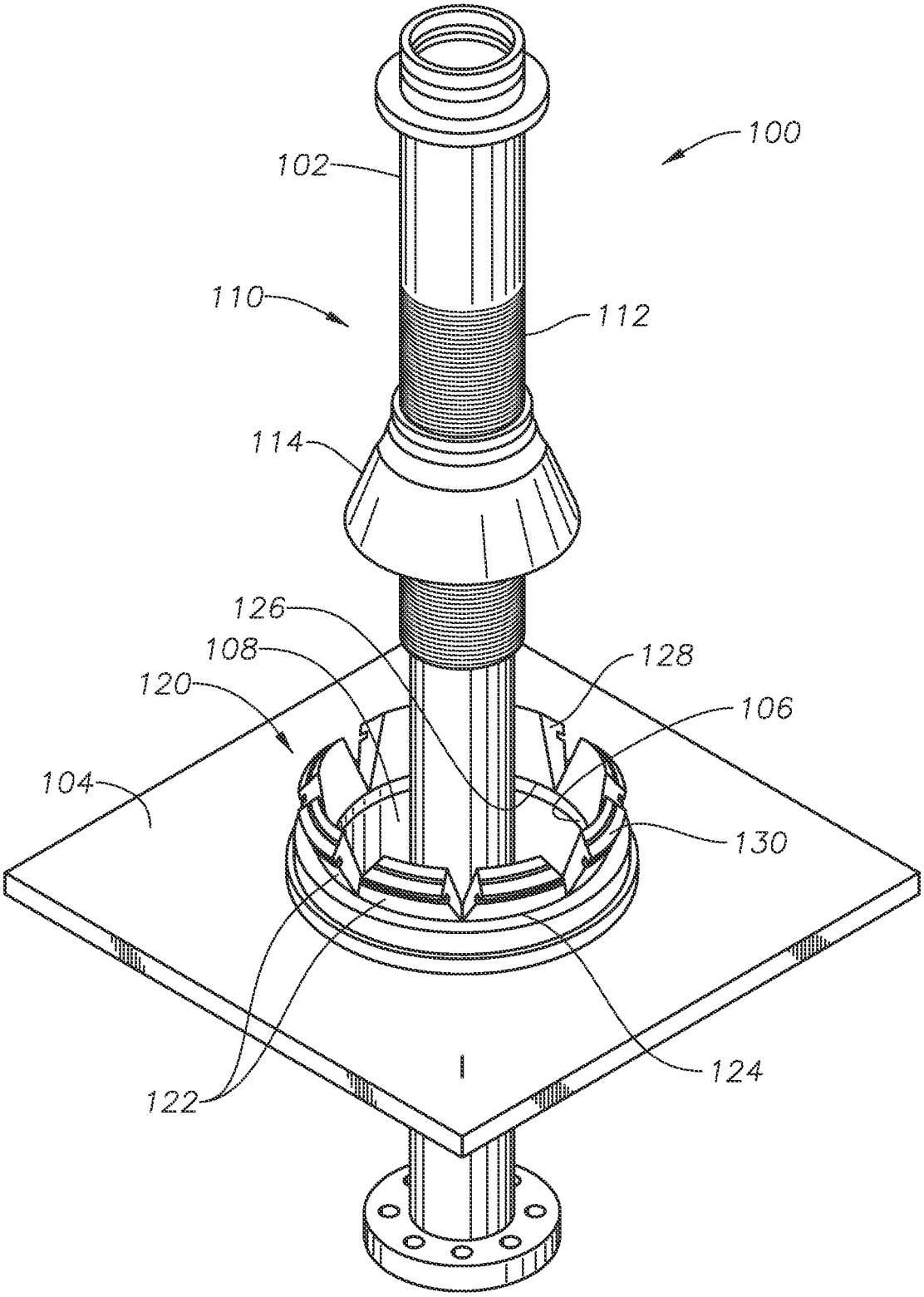
FIG. 1 is an environmental view of an embodiment of the tension latch assembly.
Figure 2:
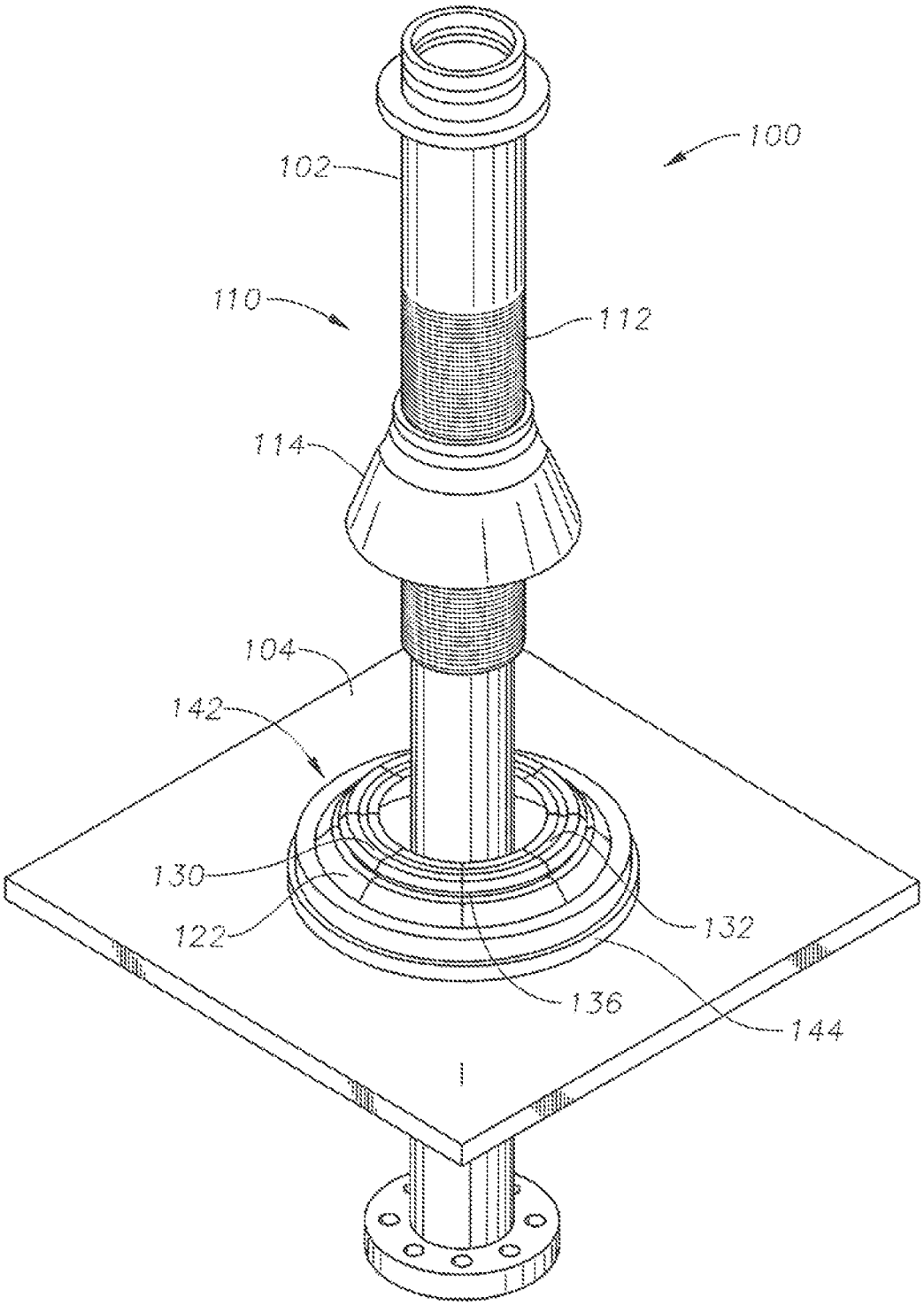
FIG. 2 is an environmental view of the tension latch assembly of FIG. 1, showing the lower latch segments in the engaged position.

Referring to FIGS. 1 and 2, a tension latch system 100 is shown. Tension latch system 100 can be used in a variety of applications requiring tension to be applied to a tubular member including, for example, the application of subsea well drilling operations. In embodiments, tension latch system 100 can be used to apply tension to riser 102, which is a riser extending from a wellhead (not shown) at the ocean floor up to a drilling platform 104 and through bore 106 of drilling platform 104. A tension conductor 108 is a tubular member extending downward from platform 104, through which riser 102 passes. The bore of tension conductor 108 can define bore 106 of drilling platform 104. Riser 102, which can be conventional, is an assembly made up of tubular riser segments. Tension joint 110 is installed as one or more segments of riser 102. Tension joint 110 is a tubular member having threads 112 on an outer diameter surface. Upper latch 114 is shown installed on tension joint 110. In embodiments, upper latch 114 has threads 116 (FIG. 3) on in inner diameter surface which threadingly engages threads 112. Upper latch 114 can, thus, be positioned anywhere along the threaded portion of tension joint 110 by rotating upper latch 114. Other techniques can be used to engage and position upper latch 114 on tension joint 110. For example, upper latch 114 can have a ratcheting mechanism (not shown) which can engage threads or wickers (not shown) on tension joint 110.

Lower latch assembly 120 includes a plurality of latch segments 122. Each latch segment 122 has a wedge shape and a pivot point 124. Pivot point 124 is at the bottom end 126 of latch segment 122, and allows latch segments 122 to move between an open position and an engaged position. The engaged position is best shown in FIG. 2. In the open position, latch segments 122 generally point upward and the inner diameter defined by the innermost portions of latch segments 122, is greater than the inner diameter of the latch segments in the engaged position. In the engaged position, latch segments 122 rotate inward until all or a portion of each side 128 of each latch segment 122 is in contact with all or a portion of an adjacent side 128 of an adjacent latch segment 122. The contact between adjacent sides 128 creates a mutual support among latch segments 122 and prevents each latch segment from moving further inward.

Figure 3:
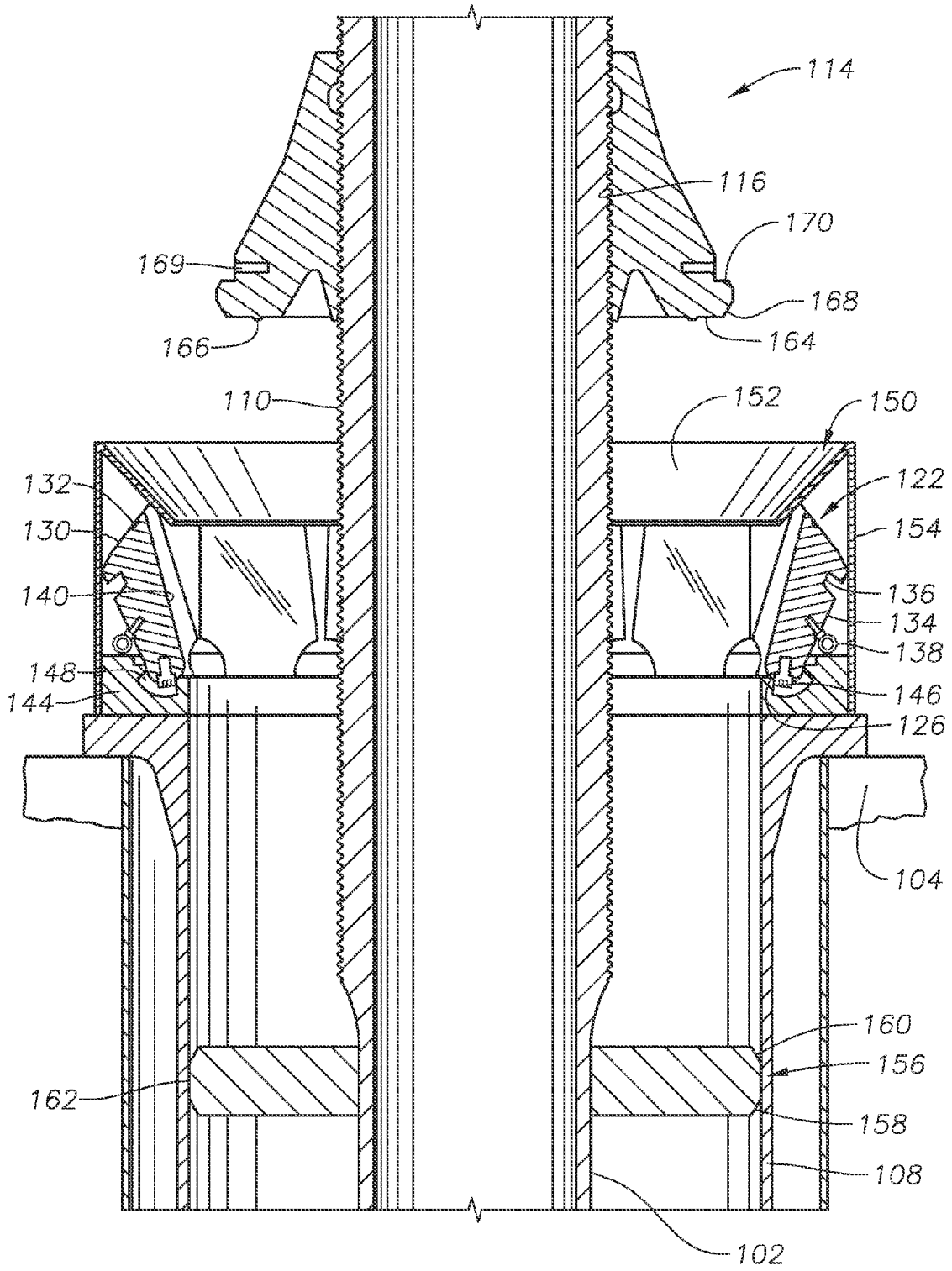
FIG. 3 is a sectional side view of the tension latch assembly of FIG. 1, showing the latch segments in the open position.
Figure 4:
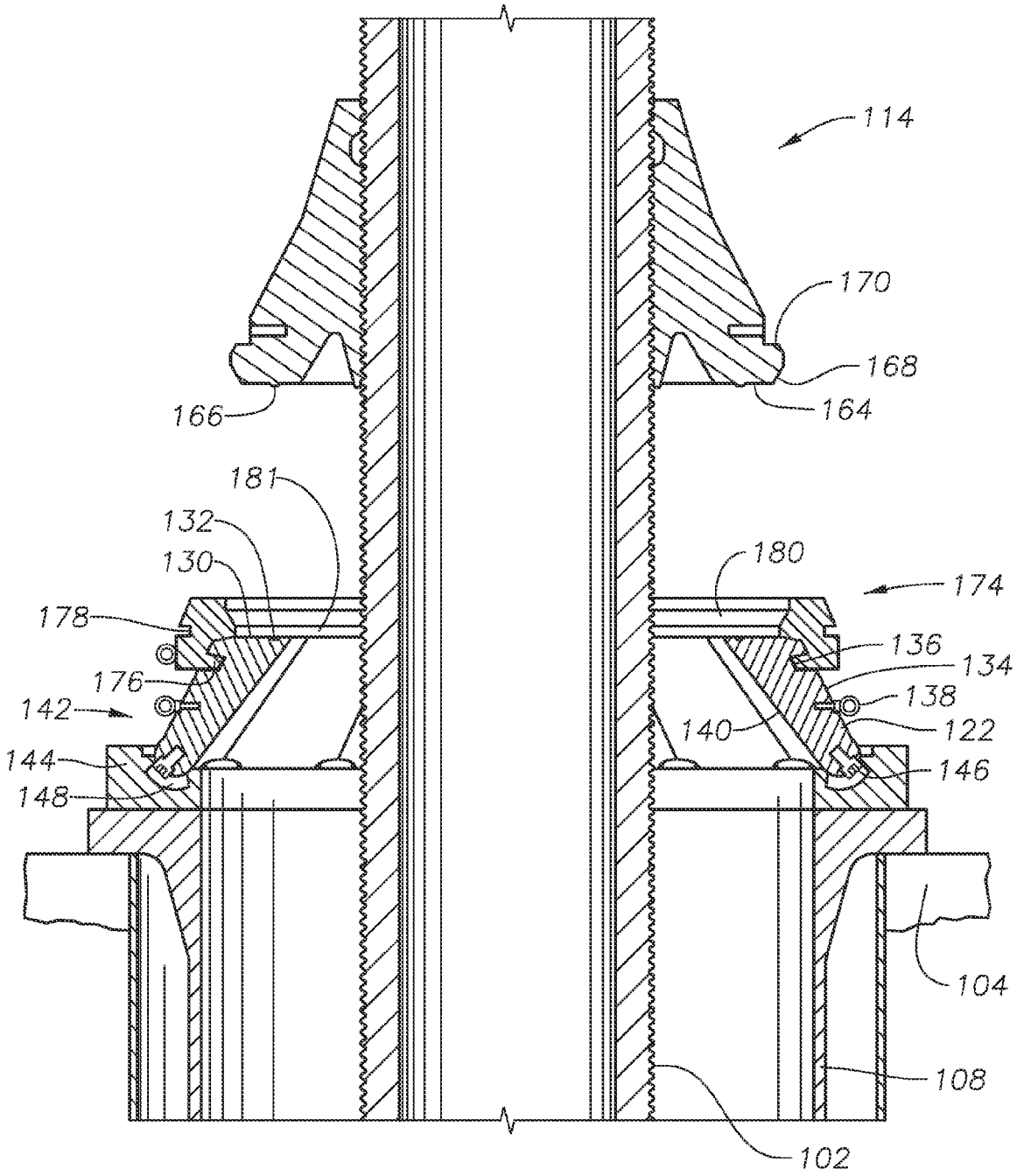
FIG. 4 is a sectional side view of the tension latch assembly of FIG. 1 showing the latch segments in the engaged position with a guide ring in place.

As best shown in FIGS. 3 and 4, each latch segment 122 includes a top surface 130 that faces generally upward when latch segments 122 are in the engaged position. Recess 132 is an alignment feature on top surface 130. Recess 132 has an arc shape such that, when latch segments 122 are in the engaged position, each recess 132 aligns with adjacent recesses 132 to form an annular recess. The outside surface 134 of each latch segment 122 faces upward and outward in the engaged position. Outside surface 134 includes one or more lock ring grooves 136. One or more eye-bolts 138 protrudes from outside surface 134 of each latch segment 122, and can be used for handling or moving each latch segment 122. Inside surface 140 is the surface generally opposite outside surface 134. Inside surface 140 faces inward, toward the axis of riser 102, in the open position, and faces inward and downward in the engaged position.

As best shown in FIGS. 2 and 4, in the engaged position, latch segments 122 come together to form lower latch ring 142. Lower latch ring 142 is a continuous annular ring made of latch segments 122, each in contact with adjacent latch segments 122. Top surfaces 130, together, form an annular top surface of lower latch ring 142. Lock ring grooves 136 each align with lock ring grooves 136 of adjacent latch segments 122 to define an annular lock ring groove around lower latch ring 142.

Referring now to FIG. 3, latch segments 122 are shown in the open position. Latch segments 122 are connected to base ring 144. Base ring 144 is an annular ring to which ends 126 of latch segments 122 are pivotally connected. Base ring 144 can be a one-piece annular ring or can be made of arc-shaped segments that are joined together to firm a ring. Alternatively, individual base elements (not shown) can be positioned around bore 106 to pivotally support latch segments 122.

A stop 146 is connected to each end 126 of latch segments 122. Stop 146 is shown as a threaded bolt positioned in a bolt hole of end 126, but other stop configurations can be used. Stop recess 148 is a recess in base ring 144 in which stop 146 is positioned. Recess 148 permits movement of stop 146, but prevents over-travel of latch segment 122 in either of the engaged or open positions by contacting stop 146.

Guide funnel 150 is a guide that is detachably connected to base ring 144 or to platform 104. Guide funnel 150 includes a funnel surface 152, that is angled upward and inward, connected to or integrally formed with support ring 154. Guide funnel 150 is a single annular member, or can be made of two or more arc-shaped segments. Guide funnel 150 can deflect members toward the axis of bore 106 including, for example, upper latch 114 or centralizer 156.

Centralizer 156 is an annular ring positioned on riser 102 or tension joint 110, typically below upper latch 114. Centralizer 156 includes downward and outward facing tapered surfaces 158, and upward and outward facing tapered surfaces 160, each at an outer diameter of centralizer 156. The outer diameter 162 of centralizer 156 is about the same as or slightly smaller than the inner diameter of tension conductor 108. As riser 102 is lowered through bore 106, centralizer 156 contacts one or more of guide funnel 150, portions of latch segments 122, and the inner diameter of tension conductor 108 to urge riser 102 into axial alignment with bore 106. The inner diameter defined by the innermost portion of latch segments 122 in the open position is greater than the largest outer diameter of centralizer 156 so that centralizer 156 can pass therethrough.

Still referring to FIG. 3, upper latch 114 can be have a generally frustoconical shape with an outer surface that generally faces outward and upward, and can have a bore therethrough. As discussed above, threads 116 can be on the inner surface of the bore. Upper latch 114 is not limited to a frustoconical shape. The outer surface can be, for example, cylindrical, octagonal, or a variety of other profiles. In embodiments, upper latch 114 can be a solid member free of moving parts.

End surface 164 is the downward facing surface at the lower end of upper latch 114. End surface 164 can generally face downward, or all or a portion of end have a downward and inward facing taper or a downward and outward facing taper. Lip 166 is an alignment feature on end surface 164, having an annular ridge protruding downward from end surface 164. Lip 166 has a diameter and contour that generally matches the diameter and contour of the annular recess defined by recesses 132. Outer taper 168 is an outward and downward facing taper at the outer diameter of end surface 164. Lock surface 170 is an upward facing surface on an outer diameter of lower latch ring 142, located above outer taper 168. One or more tool bores 169 are spaced apart around the outer diameter of upper latch 114. Each tool bore 169 can receive a rod or other tool (not shown) that can be used to rotate upper latch 114 relative to tension joint 110.

Referring now to FIG. 4, guide ring 174 is an annular ring or c-ring that is placed on and engages lower latch ring 142 to align latch segments 122. Guide ring 174 is made up of two or more arc shaped segments that are placed around riser 102 and base ring 144, and then bolted together. In embodiments, all or some of the bolts (not shown) used to bolt the segments together are flush with or recessed so that the bolts (not shown) do not protrude beyond surfaces of guide ring 174.

Guide ring 174 includes guide lock ring 176 protruding from an inner diameter surface 178. Guide lock ring 176 is sized to engage grooves 136 on latch ring 142. Guide ring 174 also includes an annular guide lock groove 178 on an outer diameter surface. Guide taper 180 is an inward and upward facing tapered surface above inner diameter surface 181. The smallest inner diameter of the guide taper 180 is less than the outer diameter of top surface 130 of lower latch ring 142, but greater than the inner diameter of top surface 130 of lower latch ring 142. Therefore, an annular portion of top surface 130 of lower latch ring 142 is exposed when guide ring 174 is secured thereto.

Guide taper 180 has a diameter and profile that engages outer taper 168 of upper latch 114. As upper latch 114 is lowered onto lower latch ring 142, the engagement between guide taper 180 and outer taper 168 urges upper latch 114, and thus tension joint 110 and riser 102, toward concentric alignment with lower latch ring 142 and, thus, bore 106. Furthermore, the engagement between guide taper 180 and outer taper 168 can limit radial movement of upper latch 114 relative to lower latch ring 142 after upper latch 114 has landed thereon. Lip 166 also engages recess 132, which also urges upper latch 114 into concentric alignment with lower latch ring 142.

Figure 5:
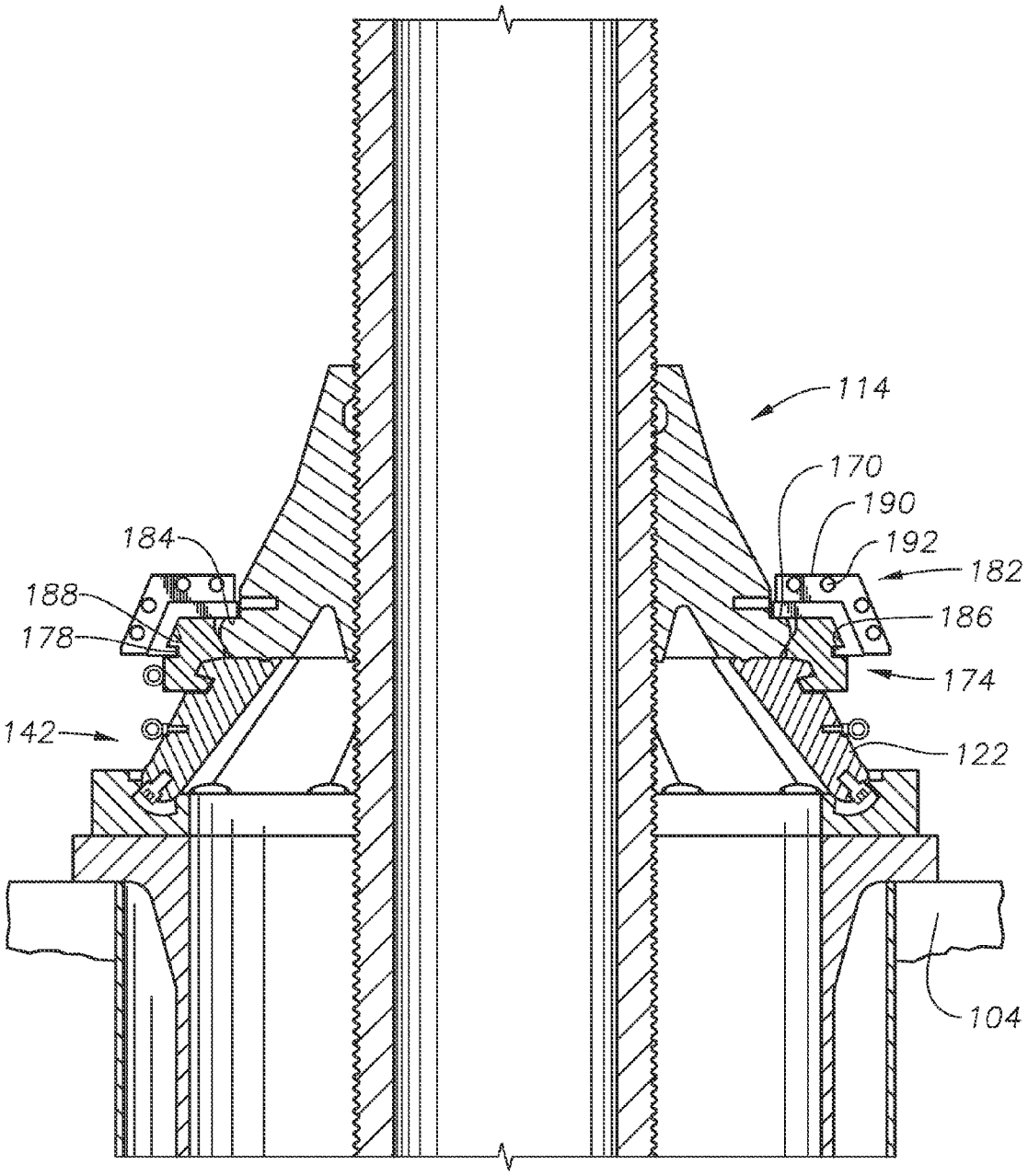
FIG. 5 is a sectional side view of the tension latch assembly of FIG. 1 showing the upper latch landed on the lower latch ring.

Referring now to FIG. 5, capture ring 182 is an annular collar that engages upper latch 114 and prevents upward axial movement of upper latch 114 relative to lower latch ring 142. Capture ring 182 has a capture ring lock surface 184 that is positioned proximate to lock surface 170 of upper latch 114. There can be a clearance, or gap, between capture ring lock surface 184 and lock surface 170 due to manufacturing tolerances and to facilitate easier assembly of the components. In the event that riser 102, and thus upper latch 114, moves axially upward, capture ring lock surface will engage lock surface 170 to prevent further upward axial movement of riser 102. Capture ring lip 186 is an annular lip that protrudes inward from an inner diameter surface of capture ring 182, and engages guide lock groove 178 to limit movement of capture ring 182 relative to lower latch ring 142. Capture ring lock surface 184 can also contact the top surface of guide ring 174, and capture ring inner diameter 188 is positioned against an outer diameter of guide ring 174. Capture ring 182 is a segmented ring having two or more arc shaped segments that are connected together by connectors to form an annular ring. As shown in FIG. 5, flange 190 is located at each end of each segment, and is connected to adjacent flanges 190 by bolts (not shown in FIG. 5) through bolt holes 192. Other techniques can be used to join segments including, for example, hinges, clamps, and bolts with threaded bolt holes.

Figure 6:
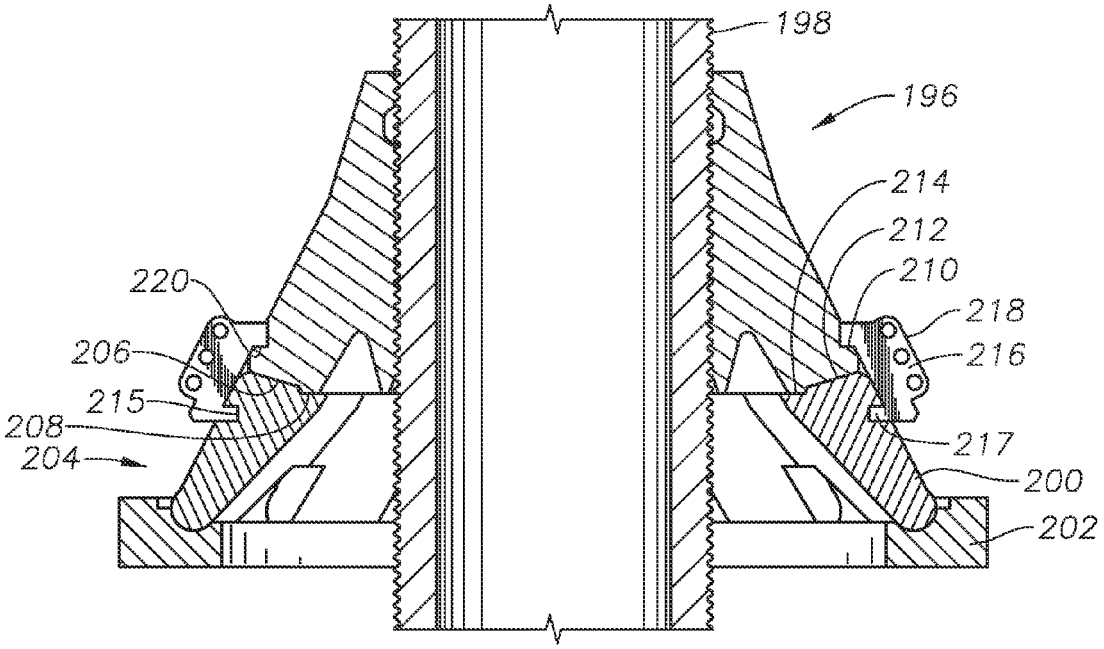
FIG. 6 is a sectional side view of an embodiment of a tension latch assembly having a tapered engagement surface.

Referring now to FIG. 6, in another embodiment, upper latch 196 is threadingly connected to tension joint 198. Latch segments 200 are each pivotally connected to base ring 202, and pivot between an open position and an engaged position, the engaged position being shown in FIG. 6. In the engaged position, a gap exists between the lower portion of each latch segment 200, while the upper portions of each latch segment 200 contact adjacent upper portions of latch segments 200 to form an annular lower latch ring 204.

The lower end of upper latch 196 includes bottom taper 206, which is a downward and slightly outward facing taper. The lower end of upper latch 196 also includes bottom lip 208, which is an annular lip spaced inward from bottom taper 206. The outer diameter of upper latch 196 includes an upward facing lock surface 210.

The upper surface of latch segments 200, when in the engaged position, has an upward and slightly inward facing taper 212 that corresponds to bottom taper 206 of upper latch 196. Recesses 214 in the upper surface of latch segments 200 form an annular recess that is spaced inward from taper 212. Bottom lip 208 of upper latch 196 engages recess 214 to concentrically align upper latch 196 with lower latch ring 142. Similarly, bottom taper 206 engages taper 212 to concentrically align, and maintain the alignment of, upper latch 196 and lower latch ring 204. Latch segments 200 each include recess 215, which is a groove on an outer diameter surface. When in the engaged position, recesses 215 align with adjacent recesses 215 to form an annular groove around the outer diameter surface of latch ring 204. Capture ring 216 is a split collar assembly having are shaped segments that are joined together by, for example, bolts through bolt holes of flanges 218. Capture ring 216 includes a lower lip 217 that engages recesses 215 and a capture ring lock surface 220 that is a downward facing shoulder on an inner diameter that engages upward facing lock surface 210.

Figure 7:
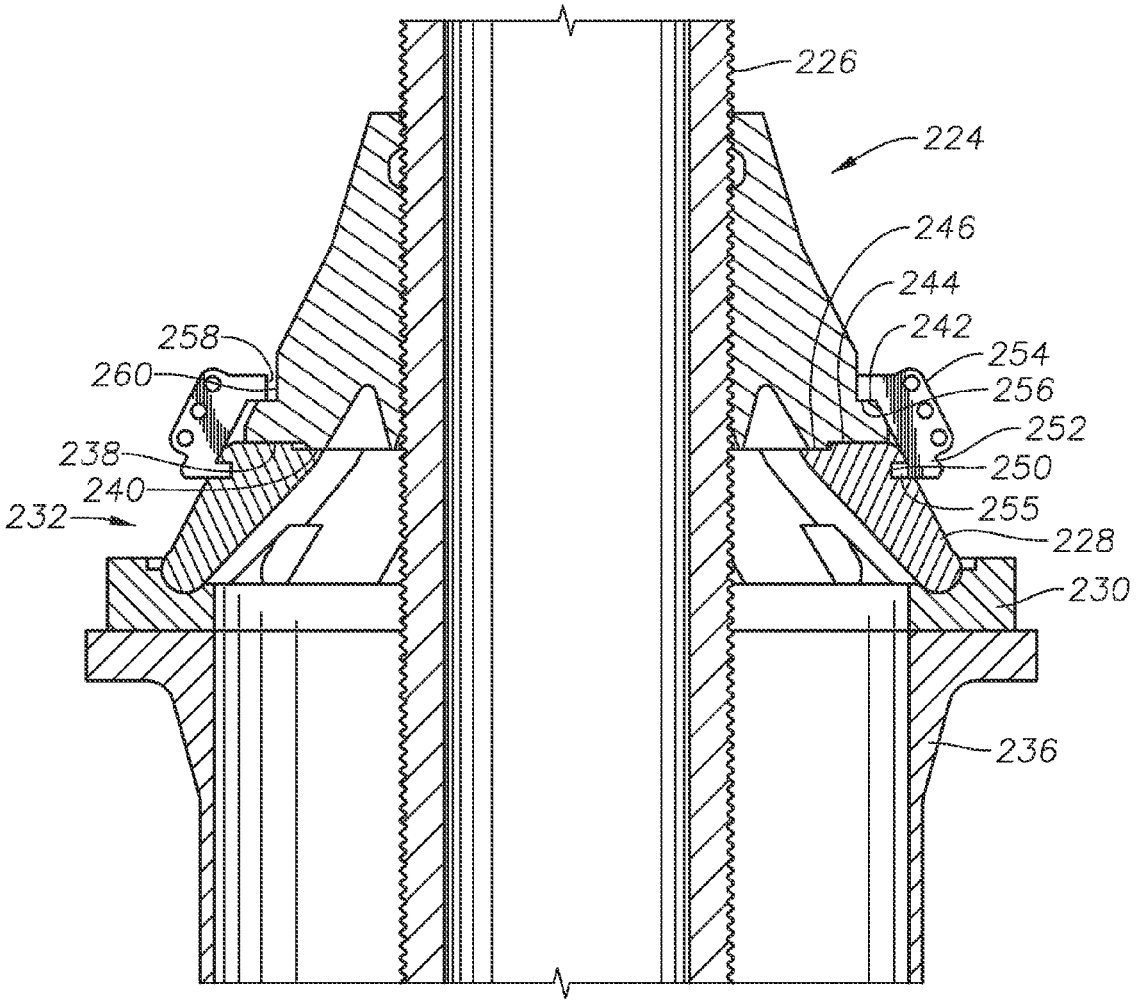
FIG. 7 is a sectional side view of an embodiment of a tension latch assembly in an offset condition.

Referring now to FIG. 7, in another embodiment, upper latch 224 is threadingly connected to tension joint 226. Latch segments 228 are each pivotally connected to base ring 230, and pivot between an open position and an engaged position, the engaged position being shown in FIG. 7. In the engaged position, the upper portions of each latch segment 228 contact adjacent upper portions of latch segments 228 to form an annular lower latch ring 232. Base ring 230 is positioned at an end of guide funnel 236.

The lower end of upper latch 224 includes a generally flat surface 238, which is perpendicular to the axis of upper latch 224. The lower end of upper latch 224 also includes bottom lip 240, which is an annular lip spaced inward from surface 238. The outer diameter of upper latch 224 includes an upward facing lock surface 242.

The upper surface of latch segments 228, when in the engaged position, has a generally flat surface 244 that is perpendicular to the axis guide funnel 236. Recesses 246 form an annular recess in surface 244. Bottom lip 240 of upper latch 224 engages recess 246 to concentrically align upper latch 224 with lower latch ring 232. Latch segments 228 each include recess 250, which is a groove on an outer diameter surface. When in the engaged position, recesses 250 align with adjacent recesses 250 to form an annular groove around the outer diameter surface of latch ring 232. Capture ring 252 is a split collar assembly having arc shaped segments that are joined together by, for example, bolts through bolt holes of flanges 254. Capture ring 252 includes a lower lip 255 that engages recesses 250 and a capture ring lock surface 256 that is a downward facing shoulder on an inner diameter that engages or is proximate to upward facing lock surface 242.

As shown in FIG. 7, capture ring 252 can still engage upper latch 224 and lower latch ring 232 even if upper latch 224 is offset from lower latch ring 232 by up to a predetermined distance. Inner diameter surface 258 of capture ring 252 is a surface that faces outer diameter surface 260 of upper latch 224. The inner diameter of inner diameter surface 258 is greater than the outer diameter of outer diameter surface 260 by an amount at least equal to the predetermined distance by which upper latch 224 can be offset from lower latch ring 248. At least a portion of lock surface 242 still engages capture ring lock surface 256 when upper latch 224 is offset from lower latch ring 232 by up to the predetermined distance. In embodiments, the predetermined distance can be about 0.1 to 1.0 inches. In embodiments, the predetermined distance can be about 0.1 to 0.5 inches. In embodiments, the predetermined distance can be about 0.1 to 0.25 inches. In embodiments, the predetermined distance can be up to about 0.25 inches.

Referring back to FIGS. 3-5, in operation latch segments 122 are pivotally connected to platform 104 by way of base ring 144, which is connected to tension conductor 108, connected to platform 104. Latch segments 122 are circumferentially positioned around bore 106. Latch segments 122 pivot at pivot point 124, at the base of each latch segment 122, from an open position to an engaged position. In the engaged position, each latch segment pivots inward, at pivot point 124, until sides 128 of each latch segment contact sides 128 of adjacent latch segments 128 to form an annular lower latch ring 142. The contact between the adjacent latch segments 122 prevents each latch segment 122 from pivoting too far toward the axis of bore 106. Latch segments 122, thus, limit the inward and downward travel distance of adjacent latch segments 122 when in the engaged position.

Upper latch 114, which is a solid annular latch ring, is threadingly connected to tension conductor 108 of riser 102. Riser 102 is lowered through bore 106 to a predetermined position, and the distal end is secured in, for example, a subsea wellhead housing. Latch segments 122 are in an open position, thus defining in inner diameter that is greater than an outer diameter of centralizer 156, so that centralizer 156 can pass through latch segments 122, and bore 106, as riser 102 is lowered. A preselected amount of tension is then drawn on riser 102, and upper latch 114 is rotated on threads 112, as needed, to position upper latch 114 at an axial position to provide a preselected final amount of tension on riser 102 after upper latch 114 is landed.

As riser 102 moves through bore 106, support ring 150 urges riser 102 toward the center of tension conductor 108. With centralizer 156 below lower latch ring 142, latch segments 122 are pivoted inward from the open position to the engaged position. In the engaged position, latch segments 122 form lower latch ring 142, which has an inner diameter that is smaller than the outer diameter of upper latch 114. Guide ring 174 is then placed on lower latch ring 142. Guide ring 174 is a segmented ring that is joined around lower latch ring 142 so that guide lock ring 176 engages groove 136. Guide ring 174, thus, secures latch segments 122 in the engaged position.

The tension on riser 102 is gradually released until upper latch 114 lands on lower latch ring 142. If riser 102 is offset in bore 106, outer taper 168 of upper latch 114 contacts guide taper 180, thus urging upper latch 114 and riser 102 toward the axis of bore 106 as upper latch 114 lands on lower latch ring 142. In embodiments having a bottom taper 206 (FIG. 6) and taper 212 (FIG. 6), the tapers act together to urge the upper latch toward the axis of the bore.

Once upper latch 114 is landed, capture ring 182 is connected to upper latch 114 and lower latch ring 142. In embodiments having a guide ring 174, capture ring 182 is connected to lower latch ring 142 via guide ring 174. Capture ring lock surface 184 engages lock surface 170 of upper latch 114 and capture ring lip 186 engages guide lock groove 178. Capture ring 182, thus, prevents riser 102 from moving upward relative to lower latch ring 142 and, therefore, relative to platform 104. Guide ring 174 engages portions of upper latch 114 to maintain axial alignment of riser 102 with bore 106. For example, guide taper 180 engages outer taper 168 to keep upper latch 114 in position. Furthermore, lip 166 of upper latch 114 engages recess 132 so that lower latch ring 142 will maintain axial alignment of upper latch 114 and, thus, riser 102. As shown in FIG. 6, embodiments having a tapered surface 206 on upper latch 196 and taper 212 on lower latch ring 204, the corresponding tapers can maintain alignment of riser 102 with bore 106.

While the invention has been shown or described in only some of its forms, it should be apparent to those skilled in the art that it is not so limited, but is susceptible to various changes without departing from the scope of the invention.

What is claimed is:

1. An apparatus for providing tension to a riser, the apparatus comprising:

a platform having a bore therethrough;

a tubular member extending through the bore;

an annular upper latch member connected to an outer diameter of the tubular member, the upper latch member having an end surface;

an annular centralizer ring connected to the outer diameter of the tubular member, axially below the upper latch member;

a plurality of latch segments positioned circumferentially around the bore, each of the plurality of latch segments being moveable between an open position and an engaged position;

the plurality of latch segments, in the open position, defining an inner diameter greater than an outer diameter of the centralizer ring; and in the engaged position, an engagement end of each of the latch segments being nearer an axis of the bore than in the open position to define an annular latch ring having an inner diameter smaller than the outer diameter of the upper latch member, and wherein each latch segment comprises two sides, each of the two sides contacting one of the two sides of an adjacent one of the plurality of latch segments in the engaged position.

2. The apparatus according to claim 1, wherein each of the latch segments support two adjacent latch segments in the engaged position to limit radial and axial movement in at least one direction.

3. The apparatus according to claim 1, wherein the annular latch ring comprises an upward and inward facing tapered surface.

4. The apparatus according to claim 1, wherein the upper latch member, upon landing on the annular latch ring, is urged toward the axis of the bore.

5. The apparatus according to claim 1, further comprising a capture ring, the capture ring being connectable to each of the upper latch member and the annular latch ring to restrain the upper latch member from moving axially away from the annular latch ring.

6. The apparatus according to claim 1, further comprising an annular guide ring, the annular guide ring being connectable to the annular latch ring and preventing each of the latch segments from moving out of the engaged position.

7. The apparatus according to claim 6, wherein the annular guide ring urges the upper latch member toward the axis of the bore as the upper latch member moves axially toward the annular latch ring.

8. The apparatus according to claim 6, wherein the annular guide ring is connectable to each of the upper latch member and the annular latch ring when the upper latch member is offset from the annular latch ring by up to a predetermined distance.

9. A method for tensioning a riser, the method comprising the steps of:

(a) connecting an upper latch member to a tension joint, the tension joint being a segment of a riser assembly and connecting an annular centralizer to an outer diameter of the riser assembly;

(b) providing a lower latch assembly, the lower latch assembly comprising a plurality of latch segments positioned around the circumference of a bore of a drilling platform, each of the segments being pivotable from an open position to an engaged position, the open position defining an inner diameter greater than an outer diameter of the centralizer and the engaged position forming an annular latch ring having an inner diameter less than the outer diameter of the upper latch member;

(c) passing the centralizer downward through the inner diameter of the lower latch assembly, then tensioning the riser assembly by drawing the tension joint upward relative to the lower latch assembly;

(d) moving the plurality of latch segments from the open position to the engaged position, and supporting each of the latch segments with two adjacent latch segments; and (e) lowering the tension joint onto the lower latch assembly until the upper latch member lands on the lower latch ring.

10. The method of claim 9, wherein step (e) further comprises connecting a capture ring to each of the upper latch member and the annular latch ring.

11. The method according to claim 10, wherein step (d) further comprises the step of connecting a guide ring to the annular latch ring, the guide ring preventing the latch segments from moving out of the engaged position; wherein step (e) further comprises the step of urging the upper latch member toward an axis of the bore; and wherein the capture ring is connected to the guide ring.

12. The method of claim 9, wherein step (e) further comprises the step of urging the upper latch member toward the bore as the upper latch member lands on the annular latch ring.

13. The method of claim 9, wherein the upper latch member further comprises an outward and downward facing taper and step (e) further comprises the step of the taper contacting the annular latch ring to center the upper latch member as the tension joint is lowered onto the annular latch ring.

14. The method of claim 9, wherein the upper latch member is threadingly connected to the tension joint, and wherein step (b) further comprises the step rotating the upper tension latch on the tension joint to axially move the upper tension latch to a position that will maintain a predetermined amount of tension after step (e).

15. An apparatus for providing tension to a riser, the apparatus comprising:

a platform having a bore therethrough;

a tubular member extending through the bore;

an annular centralizer and an annular upper latch member each connected to an outer diameter of the tubular member, the centralizer being axially below the upper latch member, the upper latch member having an end surface; and a plurality of latch segments positioned circumferentially around the bore, each of the plurality of latch segments each having a pivot end pivotally connected to the platform and an engagement end, each of the plurality of latch segments being moveable between an open position and an engaged position, the engagement end of each of the latch segments being nearer an axis of the bore than in the open position to define an annular latch ring having an inner diameter smaller than the outer diameter of the upper latch member, each of the plurality of latch segments contacting two adjacent latch segments in the engaged position, so as to restrain inward and downward movement of the each of the plurality of latch segments.

16. The apparatus according to claim 15, wherein the upper latch member, upon landing on the annular latch ring, is urged toward the axis of the bore.

17. The apparatus according to claim 15, further comprising a capture ring, the capture, ring being connectable to each of the upper latch member and the annular latch ring to restrain the upper latch member from moving axially away from the annular latch ring.

18. The apparatus according to claim 15, further comprising an annular guide ring, the annular guide ring being connectable to the annular latch ring and preventing each of the latch segments from moving out of the engaged position.

* * * * *